US010791603B2

(12) United States Patent
Wang et al.

(10) Patent No.: US 10,791,603 B2
(45) Date of Patent: Sep. 29, 2020

(54) INTEGRATED CIRCUIT, DIMMABLE LIGHT-EMITTING DIODE DRIVING CIRCUIT AND DRIVING METHOD

(71) Applicant: Silergy Semiconductor Technology (Hangzhou) LTD, Hangzhou, Zhejiang Province (CN)

(72) Inventors: Jianxin Wang, Hangzhou (CN); Guojia Liu, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 16/590,503

(22) Filed: Oct. 2, 2019

(65) Prior Publication Data

US 2020/0128635 A1 Apr. 23, 2020

(30) Foreign Application Priority Data

Oct. 17, 2018 (CN) ..... 2018 1 1209486

(51) Int. Cl.

| | |
|---|---|
| ***H05B 33/08*** | (2020.01) |
| ***H05B 37/02*** | (2006.01) |
| ***H05B 45/37*** | (2020.01) |
| ***H05B 45/395*** | (2020.01) |
| ***H05B 45/44*** | (2020.01) |
| ***H05B 45/10*** | (2020.01) |
| ***H05B 45/3575*** | (2020.01) |

(52) U.S. Cl.

CPC ..... *H05B 45/37* (2020.01); *H05B 45/10* (2020.01); *H05B 45/3575* (2020.01); *H05B 45/395* (2020.01); *H05B 45/44* (2020.01)

(58) Field of Classification Search

CPC ..... H05B 45/37; H05B 45/10; H05B 45/46; H05B 45/00; H05B 45/20; H05B 45/48; H05B 45/50; H05B 45/14; H05B 45/24; H05B 45/44; H05B 45/395; H05B 47/10

See application file for complete search history.

(56) References Cited

U.S. PATENT DOCUMENTS

| | | | | |
|---|---|---|---|---|
| 8,068,587 | B2 * | 11/2011 | Geldenbott | H04M 3/5116 379/45 |
| 8,581,518 | B2 | 11/2013 | Kuang et al. | |
| 9,872,355 | B2 * | 1/2018 | Wang | H05B 45/10 |
| 9,924,569 | B2 * | 3/2018 | Wang | H05B 45/20 |
| 10,285,229 | B2 * | 5/2019 | Wang | H05B 45/10 |
| 10,327,297 | B2 * | 6/2019 | Wang | H05B 45/10 |
| 10,356,864 | B2 * | 7/2019 | Chen | H05B 45/37 |
| 10,433,384 | B2 * | 10/2019 | Huang | H05B 45/37 |
| 2011/0127925 | A1 | 6/2011 | Huang et al. | |
| 2014/0015322 | A1 * | 1/2014 | Milavec | H02J 1/10 307/52 |
| 2017/0318639 | A1 | 11/2017 | Wang et al. | |

(Continued)

*Primary Examiner* — Vibol Tan

(74) *Attorney, Agent, or Firm* — Michael C. Stephens, Jr.

(57) ABSTRACT

A method of controlling a dimmable LED driving circuit, can include: detecting a voltage across an electrolytic capacitor in the LED driving circuit; determining whether the voltage across the electrolytic capacitor is less than a predetermined value; and charging the electrolytic capacitor by an auxiliary circuit when the voltage across the electrolytic capacitor is less than the predetermined value, in order to reduce time required for the voltage across the electrolytic capacitor to rise to a start-up voltage of an LED load.

20 Claims, 7 Drawing Sheets

(56) References Cited

U.S. PATENT DOCUMENTS

| | | | | |
|---|---|---|---|---|
| 2018/0295685 | A1 | 10/2018 | Wang et al. | |
| 2018/0295690 | A1 | 10/2018 | Chen et al. | |
| 2018/0310376 | A1 | 10/2018 | Huang et al. | |
| 2019/0029093 | A1* | 1/2019 | Yan | H05B 45/37 |
| 2019/0037659 | A1* | 1/2019 | Chen | H05B 45/10 |

* cited by examiner

INTEGRATED CIRCUIT, DIMMABLE LIGHT-EMITTING DIODE DRIVING CIRCUIT AND DRIVING METHOD

RELATED APPLICATIONS

This application claims the benefit of Chinese Patent Application No. 201811209486.4, filed on Oct. 17, 2018, which is incorporated herein by reference in its entirety.

FIELD OF THE INVENTION

The present invention generally relates to the field of power electronics, and more particularly to integrated circuits, dimmable light-emitting diode (LED) driving circuits, and associated driving methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Light-emitting diode (LED) lighting is widely used in furniture, offices, outdoor lighting, stage lighting, and so on. The brightness of an LED load can be regulated with dimming technology, thereby expanding the applications of the LED lighting and improving user experience. The start-up time of an LED load may be related to a bus voltage, a duty ratio of the dimming signal, and an electrolytic capacitor connected in parallel with the LED load. However, when the electrolytic capacitor is relatively large in capacitance and the duty ratio of the dimming signal is relatively small, the start-up time of the LED load can become too long.

Figure 1:
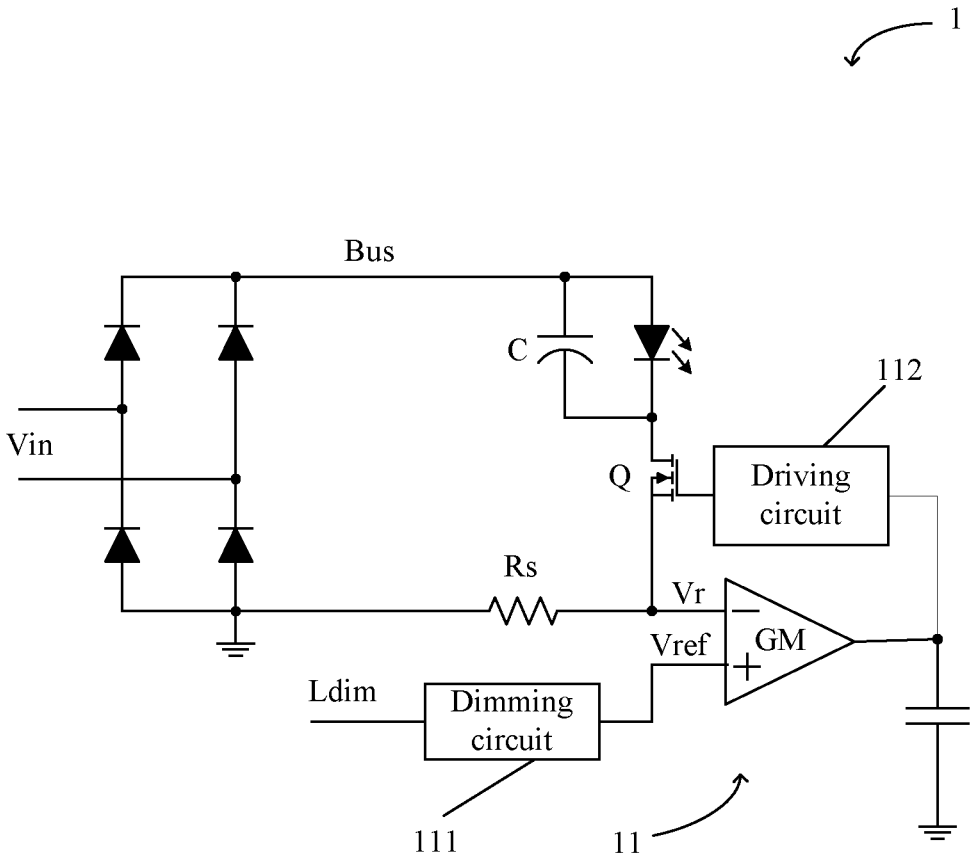
FIG. 1 is a schematic block diagram of an example dimmable LED driving circuit.

Referring now to FIG. 1, shown is a schematic block diagram of an example dimmable LED driving circuit. In this particular example, dimmable LED driving circuit 1 can include electrolytic capacitor C connected in parallel with an LED load, transistor Q, sampling resistor Rs, and current control loop circuit 11. Current control loop circuit 11 can include dimming circuit 111, error amplifier GM, and driving circuit 112. Current control loop circuit 11 can regulate the current flowing through transistor Q according to dimming signal Ldim. Dimming signal Ldim may be a pulse-width modulation (PWM) signal or an analog dimming signal. After the dimmable LED driving circuit has started up, electrolytic capacitor C may be charged such that voltage Vc across electrolytic capacitor C reaches a driving voltage of the LED load, thereby driving the LED load to operate. As shown in FIG. 1, charging voltage Vc of electrolytic capacitor C may be calculated by:

$$Vc = \frac{1}{c} * \frac{Vref}{Rs} * t$$

For example, c is the capacitance of electrolytic capacitor C, Vref is a reference signal generated by dimming circuit 111 according to dimming signal Ldim, and t is the charging time of the electrolytic capacitor. It can be understood that reference signal Vref decreases as the duty ratio of dimming signal Ldim decreases, or reference signal Vref decreases per the amplitude of dimming signal Ldim. Therefore, a relatively small duty ratio of dimming signal Ldim can result in a relatively small current for charging electrolytic capacitor C, which may be generated after dimmable LED driving circuit 1 has started up. This can result in a relatively long time required for voltage Vc across electrolytic capacitor C to rise to a start-up voltage of the LED load. That is, the dimmable LED driving circuit may have a relatively long start-up time in this case.

In particular embodiments, when the voltage across the electrolytic capacitor is less than the start-up voltage of the LED load, the electrolytic capacitor may be additionally charged in order to reduce the time required for the voltage across the electrolytic capacitor to rise to the start-up voltage of the LED load. In this way the start-up speed of the dimmable LED driving circuit can be increased. In one embodiment, a dimmable LED driving circuit can include: (i) an electrolytic capacitor coupled in parallel to an output port of the dimmable LED driving circuit; and (ii) an auxiliary circuit configured to, when determining that a voltage across the electrolytic capacitor is less than a predetermined value, charge the electrolytic capacitor to reduce time required for the voltage across the electrolytic capacitor to rise to a start-up voltage of an LED load. In one embodiment, an integrated circuit for a dimmable LED driving circuit can include: (i) an electrolytic capacitor; (ii) a controlled current source; and (iii) an auxiliary circuit configured to, when determining that a voltage across the electrolytic capacitor is less than a start-up voltage of an LED load, regulate a current supplied by the controlled current source in order to charge the electrolytic capacitor.

Figure 2:
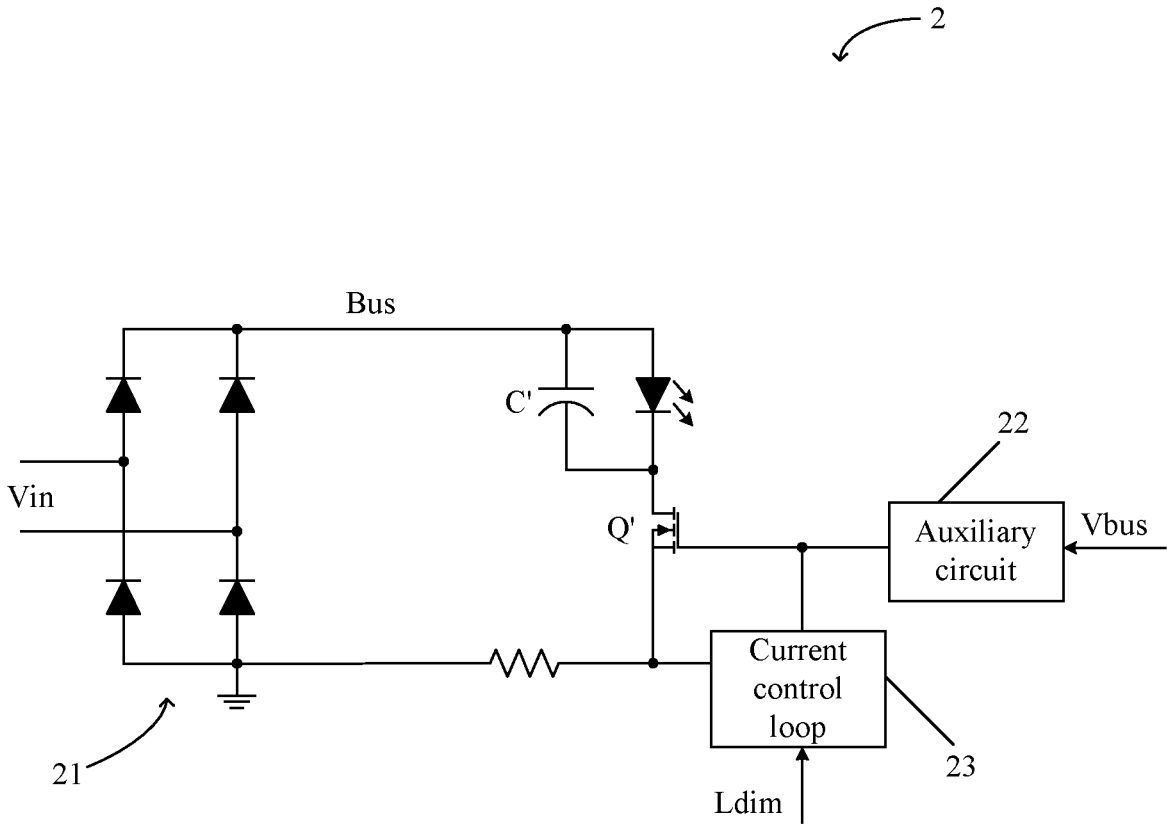
FIG. 2 is a schematic block diagram of an example dimmable LED driving circuit, in accordance with embodiments of the present invention.

Referring now to FIG. 2, shown is a schematic block diagram of an example dimmable LED driving circuit, in accordance with embodiments of the present invention. In this particular example, dimmable LED driving circuit 2 can include rectifier circuit 21, electrolytic capacitor C', transistor Q', auxiliary circuit 22, and current control loop circuit 23. Rectifier circuit 21 can convert an alternating current (AC) input to a direct current (DC) output to direct current bus Bus. Electrolytic capacitor C' can connect in parallel with the LED load between the output ends of dimmable LED driving circuit 2. Auxiliary circuit 22 can, when determining that the voltage across electrolytic capacitor C' is less than a predetermined value, charge electrolytic capacitor C' in order to reduce the time required for the voltage across electrolytic capacitor C' to rise to the start-up voltage of the LED load. Whether the voltage across electrolytic capacitor C' is less than the predetermined value can be determined by detecting a bus voltage, or by detecting a voltage at either end of electrolytic capacitor C'.

In certain embodiments, auxiliary circuit 22 can be turned off when the voltage across electrolytic capacitor C' rises to the predetermined value. For example, the predetermined value may be less than or equal to the start-up voltage of the LED load. Moreover, current control loop circuit 23 can, when the voltage across electrolytic capacitor C' rises to the predetermined value, continuously charge electrolytic capacitor C' until the voltage across electrolytic capacitor C' rises to the start-up voltage of the LED load. This can activate the LED load and regulate the current flowing through the LED load according to a reference signal, in order to adjust the brightness of the LED load. In this way, the LED load can be activated stably and relatively quickly.

In particular embodiments, current control loop circuit 23 can charge electrolytic capacitor C' when the voltage across electrolytic capacitor C' is less than the start-up voltage of the LED load to activate the LED load, and regulate the current flowing through the LED load according to dimming signal Ldim. In addition, the reference signal can be set in accordance with the particular application. For example, the reference signal can be generated in accordance with dimming signal Ldim, and dimming signal Ldim may be a PWM dimming signal or an analog dimming signal.

In particular embodiments, when the voltage across the electrolytic capacitor is less than the start-up voltage of the LED load, the electrolytic capacitor may be additionally charged in order to reduce the time required for the voltage across the electrolytic capacitor to rise to the start-up voltage of the LED load, thereby increasing the start-up speed of the dimmable LED driving circuit.

Figure 3:
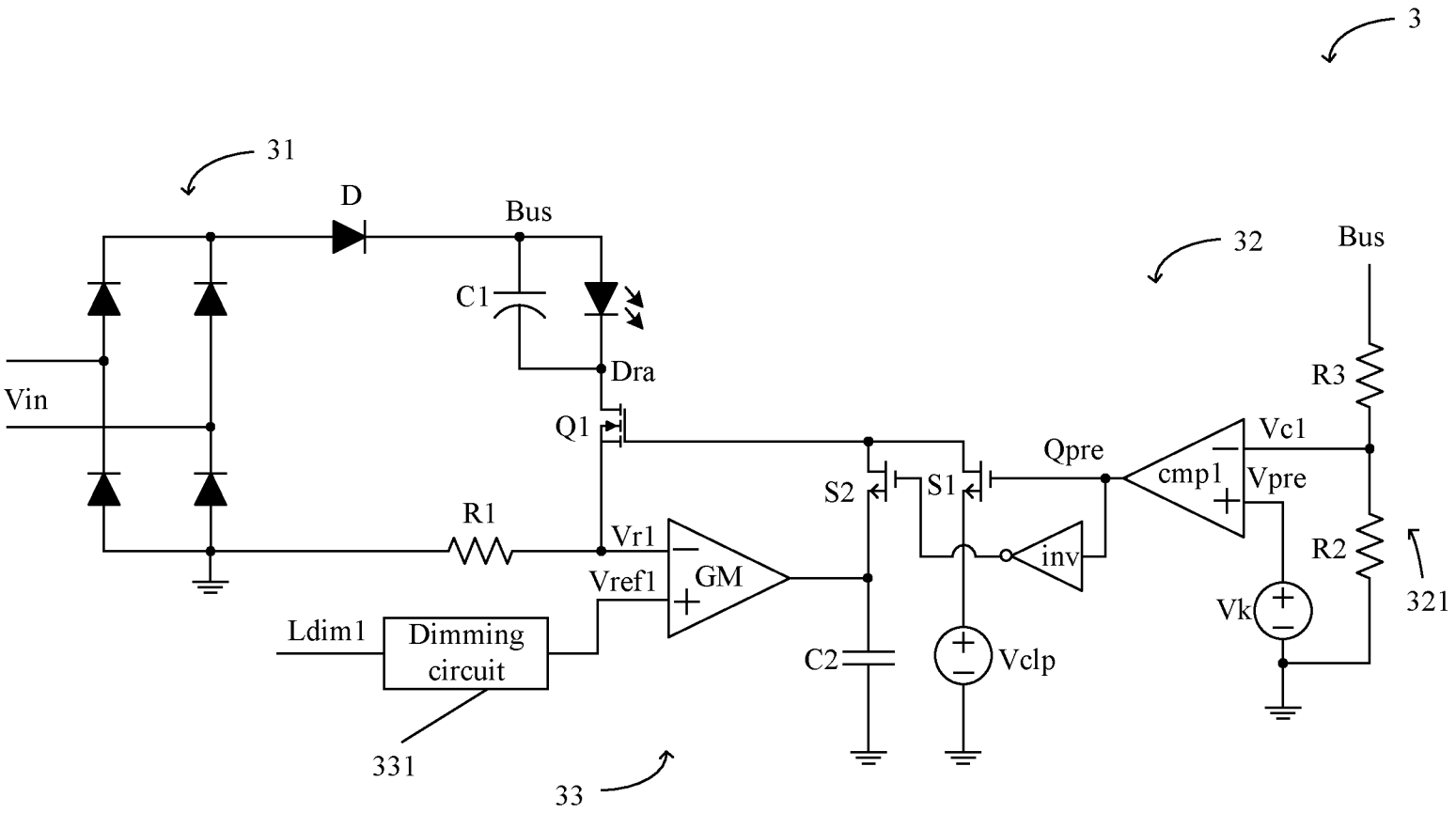
FIG. 3 is a schematic block diagram of a first example dimmable LED driving circuit, in accordance with embodiments of the present invention.

Referring now to FIG. 3, shown is a schematic block diagram of a first example dimmable LED driving circuit, in accordance with embodiments of the present invention. In this particular example, dimmable LED driving circuit 3 can include rectifier circuit 31, electrolytic capacitor C1, transistor Q1, resistor R1, auxiliary circuit 32, and current control loop circuit 33. Rectifier circuit 31 can convert the alternating current input to a direct current output to direct current bus Bus. Electrolytic capacitor C1 can connect in parallel with the LED load between the output ends of dimmable LED driving circuit 3. Transistor Q1 can connect in series into a current loop of electrolytic capacitor C1. Auxiliary circuit 32 can, when the voltage across electrolytic capacitor C1 is less than a predetermined value, control the current flowing through transistor Q1 in order to charge electrolytic capacitor C1.

Current control loop circuit 33 can, when the voltage of electrolytic capacitor C1 reaches the predetermined value, control the dimmable LED driving circuit to operate in a closed loop according to dimming signal Ldim1. The predetermined value may be less than or equal to the start-up voltage of the LED load. In this case, after dimmable LED driving circuit 3 has turned on, auxiliary circuit 32 can control transistor Q1 to pre-charge electrolytic capacitor C1, and may be turned off after the voltage of electrolytic capacitor C1 has reached the predetermined value. Current control loop circuit 33 can control transistor Q1, through the closed loop, to continuously charge electrolytic capacitor C1 until the voltage of electrolytic capacitor C1 reaches the start-up voltage of the LED load, such that the LED load starts working, and the current flowing through the LED load is regulated according to dimming signal Ldim1.

As shown in FIG. 3, auxiliary circuit 32 can include voltage sampling circuit 321, voltage source Vk, comparator cmp1, voltage source Vclp, and switch S1. Voltage sampling circuit 321 can include resistors R2 and R3 for acquiring voltage sampling signal Vc1 that represents the voltage across electrolytic capacitor C1. For example, the sampling point of voltage sampling circuit 321 may be at either end/terminal of electrolytic capacitor C1. That is, the sampling point may be at direct current bus Bus or at common node Dra of electrolytic capacitor C1 and transistor Q1. For example, dimmable LED driving circuit 3 can also include diode D, which can connect between the output end of rectifier circuit 31 and electrolytic capacitor C1, in order to prevent a reverse current. The sampling point of voltage sampling circuit 321 can also be at the output end of the rectifier circuit.

When the sampling point is at direct current bus Bus, voltage sampling circuit 321 can connect between direct current bus Bus and ground. Comparator cmp1 can compare reference value Vpre against voltage sampling signal Vc1 that represents the voltage across electrolytic capacitor C1, in order to generate control signal Qpre for controlling switch S1. For example, reference value Vpre can correspond to the predetermined value. As shown in FIG. 3, reference value Vpre may be the voltage of voltage source Vk, and the predetermined value may be (R2+R3)Vk/R2.

When voltage sampling signal Vc1 is less than reference value Vpre (e.g., the voltage across electrolytic capacitor C1 is less than the predetermined value), comparator cmp1 can activate control signal Qpre to control switch S1 to be turned on, thereby controlling current iq1 flowing through transistor Q1 to be the predetermined pre-charge current. That is, electrolytic capacitor C1 may be charged with the pre-charge current. The pre-charge current may be related to voltage source Vclp, and thus can be regulated by configuring voltage source Vclp according to particular applications. For example, auxiliary circuit 32 can also include inverter inv and switch S2. Switch S2 can connect current control loop circuit 33. Inverter inv can connect between the output of comparator cmp1 and the control end of switch S2, and can control switch S2 to be turned off when the voltage across electrolytic capacitor C1 is less than the predetermined value, in order to disable control current control loop 33 circuit.

When voltage sampling signal Vc1 reaches reference value Vpre (e.g., the voltage across electrolytic capacitor C1 reaches the predetermined value), comparator cmp1 may deactivate control signal Qpre to control the switch S1 to be turned off and switch S2 to be turned on. In this case, auxiliary circuit 32 may be controlled to be turned off, and current control loop circuit 33 can control the dimmable LED driving circuit to start to operate in a closed loop.

Current control loop circuit 33 can include dimming circuit 331, error amplifier GM, and capacitor C2. When switch S2 is controlled to be turned on (e.g., when current control loop circuit 33 is enabled), error amplifier GM, capacitor C2, resistor R1, and transistor Q1 may form a controlled current source, which can be controlled by dimming signal Ldim1 to regulate the current of the closed loop where electrolytic capacitor C1 is located and/or the current of the closed loop where the LED load is located. Dimming circuit 331 can generate reference value Vref1 based on dimming signal Ldim1. Dimming circuit 331 can generate reference value Vref1 according to a predetermined dimming curve after receiving dimming signal Ldim1. The dimming curve may include a logarithmic dimming curve and a linear dimming curve, etc., which may be selected according to the particular application.

During the pre-charge phase of electrolytic capacitor C1 (e.g., during the operation of auxiliary circuit 32), error amplifier GM can charge capacitor C2 according to reference value Vref1 and current sampling signal Vr1, which may represent the current flowing through transistor Q1. That is, during the pre-charging phase of electrolytic capacitor C1, voltage Vc2 of capacitor C2 may continuously increase, such that after switch S2 is turned on, current control loop circuit 33 can control transistor Q1 to be turned on immediately to continuously charge electrolytic capacitor C1.

That is, after the pre-charging phase ends, current control loop circuit 33 can control the output current of the controlled current source (e.g., including error amplifier GM, capacitor C2, resistor R1, and transistor Q1) according to dimming signal Ldim1, to continuously charge electrolytic capacitor C1, until the voltage across electrolytic capacitor C1 reaches the start-up voltage of the LED load, thereby activating the LED load. Then, current control loop circuit 33 can regulate the brightness of the LED load by regulating the current flowing through the LED load according to dimming signal Ldim1.

In particular embodiments, the dimmable LED driving circuit can include the dimming circuit in order to dim the LED load. When the voltage across the electrolytic capacitor is less than the start-up voltage of the LED load, the electrolytic capacitor may be additionally charged by the auxiliary circuit in order to reduce the time required for the voltage across the electrolytic capacitor to rise to the start-up voltage of the LED load, thereby increasing the start-up speed of the dimmable LED driving circuit.

Figure 4:
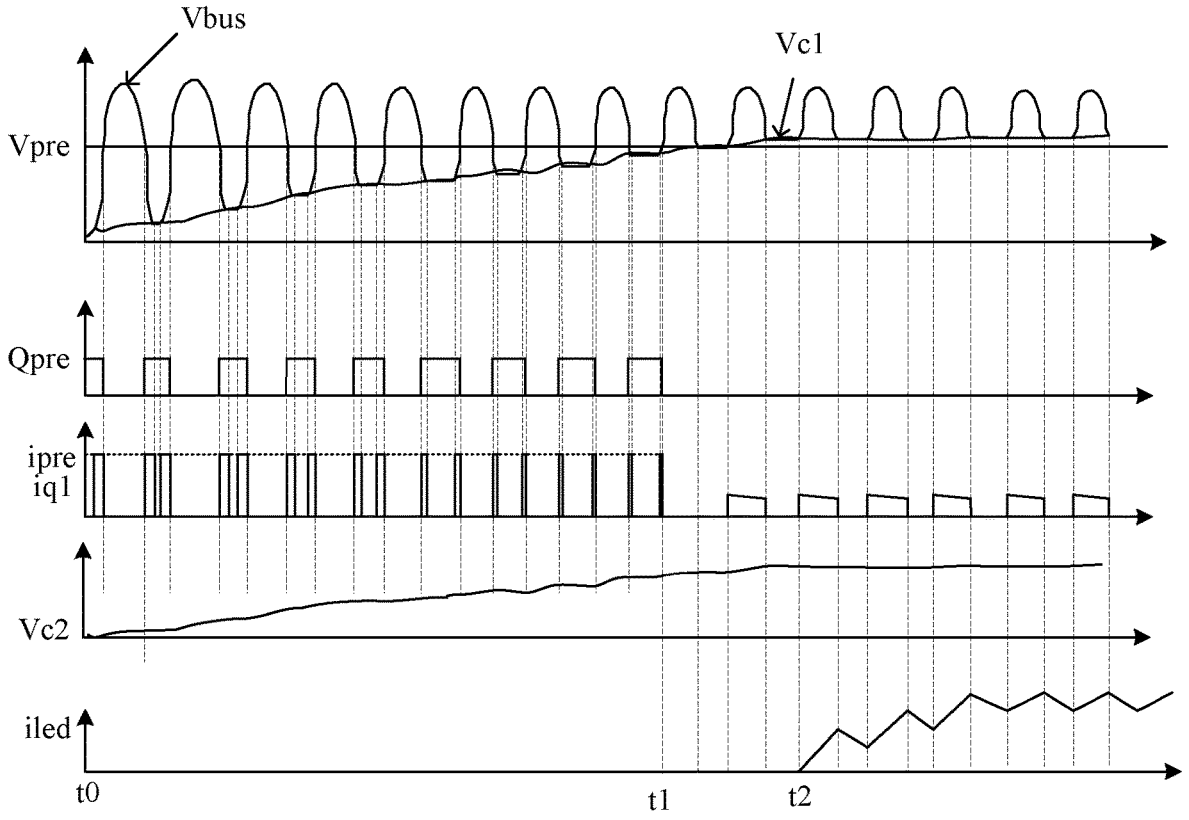
FIG. 4 is a waveform diagram of example operation of the example dimmable LED driving circuit of FIG. 3, in accordance with embodiments of the present invention.

Referring now to FIG. 4, shown is a waveform diagram of example operation of the example dimmable LED driving circuit of FIG. 3, in accordance with embodiments of the present invention. In this particular example, the voltage across electrolytic capacitor C1 may be less than a predetermined value during time t0 to t1, and the predetermined value may be slightly less than the start-up voltage of the LED load. When voltage sampling signal Vc1, which represents the voltage across electrolytic capacitor C1, is less than reference value Vpre, comparator cmp1 may activate control signal Qpre to control switch S1 to be turned on. When voltage Vdra of the point Dra is greater than 0 (e.g., direct current bus voltage Vbus of direct current bus Bus is greater than the voltage Vled of the LED load), transistor Q1 may be turned on, and current iq1 flowing through transistor Q1 may be pre-charge current ipre.

That is, when control signal Qpre is active and voltage Vdra of the point Dra is greater than 0 during time t0 to t1, electrolytic capacitor C1 may be charged with the pre-charge current, such that the voltage across electrolytic capacitor C1 quickly reaches the predetermined value, thereby increasing the start-up speed of the dimmable LED driving circuit. In addition, error amplifier GM can charge capacitor C2 according to current sampling signal Vr1, which may represent the current flowing through transistor Q1, and reference value Vref1, during time t0 to t1. Therefore, voltage Vc2 of capacitor C2 can gradually rise during time t0 to t1.

In some embodiments, the predetermined voltage may be set to be less than the start-up voltage of the LED load, such that when performing closed-loop control on the dimmable LED driving circuit, current control loop circuit 33 can continuously charge electrolytic capacitor C1 until the voltage reaches the start-up voltage of the LED load, and can control the current iled of the LED load to remain stable after the LED load starts to operate normally, thereby improving the stability of the dimmable LED driving circuit at the start-up.

At time t1, the voltage across electrolytic capacitor C1 can reach the predetermined value. At this time, reference value Vpre may not be greater than voltage sampling signal Vc1, such that control signal Qpre may be low, switch S1 may be turned off, and switch S2 can be turned on. That is, auxiliary circuit 32 can stop operating, and current control loop circuit 33 may start to perform closed-loop control on the dimmable LED driving circuit according to dimming signal Ldim1. Since the predetermined value is less than the start-up voltage of the LED load, current control loop circuit 33 can control transistor Q1 to generate a current, in order to continuously charge the electrolytic capacitor.

At time t2, the voltage across electrolytic capacitor C1 may reach the start-up voltage of the LED load, such that the LED load starts to work, thus completing the start-up process of the dimmable LED driving circuit. In certain embodiments, when the voltage across the electrolytic capacitor is less than the predetermined value, the electrolytic capacitor may be additionally charged by the auxiliary circuit in order to reduce the time required for the voltage across the electrolytic capacitor to rise to the start-up voltage of the LED load, thereby increasing the start-up speed of the dimmable LED driving circuit.

Figure 5:
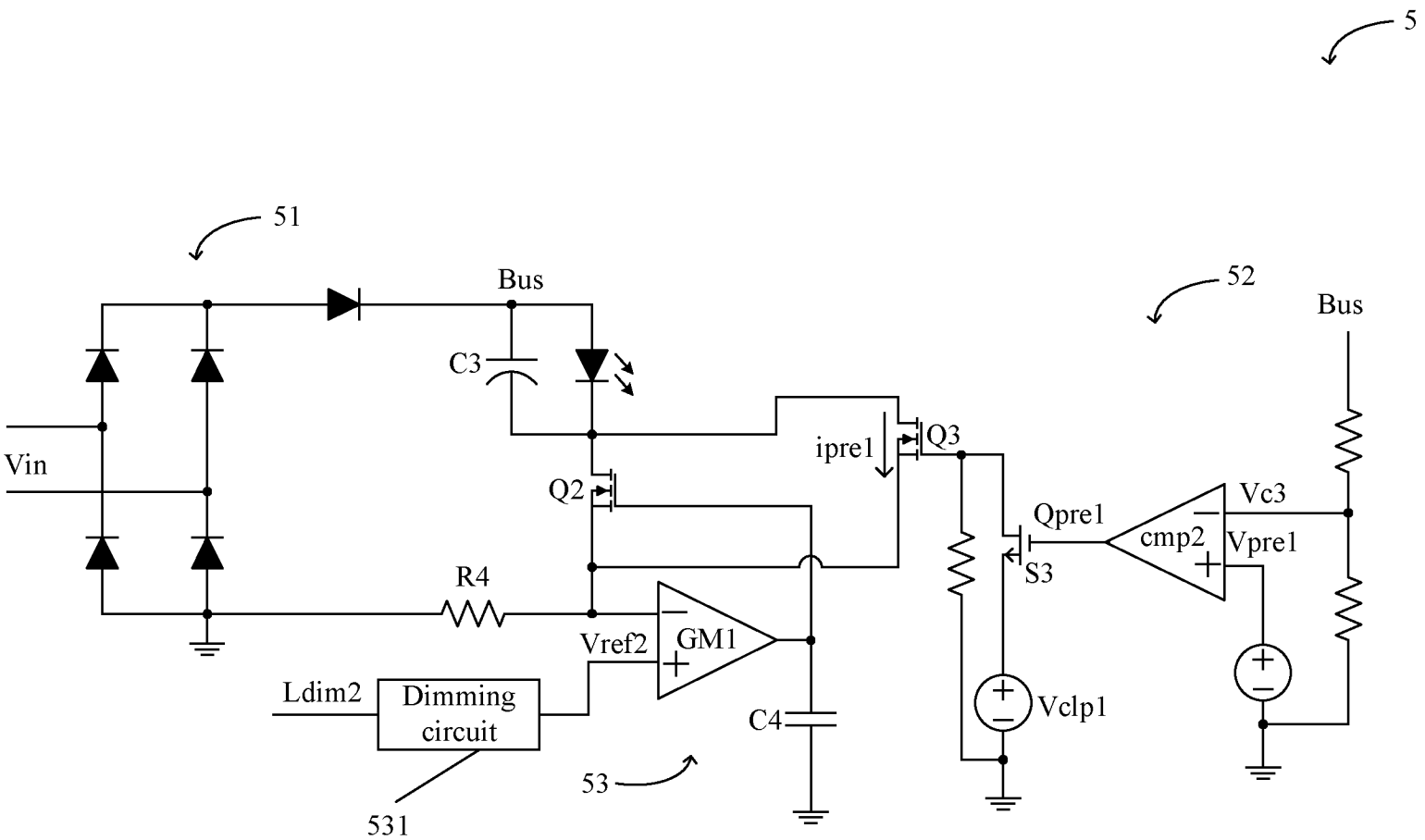
FIG. 5 is a schematic block diagram of a second example dimmable LED driving circuit, in accordance with embodiments of the present invention.

Referring now to FIG. 5, shown is a schematic block diagram of a second example dimmable LED driving circuit, in accordance with embodiments of the present invention. In this particular example, dimmable LED driving circuit 5 can include rectifier circuit 51, electrolytic capacitor C3, transistors Q2 and Q3, resistor R4, auxiliary circuit 52, and current control loop circuit 53. Rectifier circuit 51 can convert the alternating current input to a direct current output to direct current bus Bus. Electrolytic capacitor C3 can connect in parallel with the LED load between the output ends of the dimmable LED driving circuit. Transistors Q2 and Q3 can connect in parallel into a current loop of electrolytic capacitor C3. Auxiliary circuit 52 can, when the voltage across electrolytic capacitor C3 is less than a predetermined value, control the current flowing through transistor Q3 to charge electrolytic capacitor C3.

Current control loop 53 can, when the voltage of electrolytic capacitor C3 reaches the predetermined value, control the dimmable LED driving circuit to operate in a closed loop according to dimming signal Ldim2. For example, the predetermined value may be less than or equal to the start-up voltage of the LED load. When the predetermined value is less than the start-up voltage of the LED load, after dimmable LED driving circuit 5 is turned on, auxiliary circuit 52 can control transistor Q3 to pre-charge electrolytic capacitor C3, and may be controlled be turned off after the voltage of electrolytic capacitor C3 reaches the predetermined value. Current control loop circuit 53 can control transistor Q2 through the closed loop, to continuously charge electrolytic capacitor C3, until the voltage of electrolytic capacitor C3 reaches the start-up voltage of the LED load, and the current flowing through the LED load can be regulated according to dimming signal Ldim2 after the LED load starts working.

For example, auxiliary circuit 52 can include comparator cmp2, switch S3, and voltage source Vclp1. Voltage sampling signal Vc3, which may represent the voltage across electrolytic capacitor C3, and reference value Vpre1, can be input to comparator cmp2. For example, reference value Vpre1 can correspond to the predetermined value. When voltage sampling signal Vc3 is less than reference value Vpre1 (e.g., the voltage across electrolytic capacitor C3 is less than the predetermined value), comparator cmp2 may activate control signal Qpre1 to control switch S3 to be turned on, thereby controlling transistor Q3 to pre-charge electrolytic capacitor C3 with pre-charge current ipre1. Pre-charge current ipre1 may be related to voltage source Vclp1, and thus can be regulated by configuring the voltage of voltage source Vclp according to particular applications. When voltage sampling signal Vc3, which may represent the voltage across electrolytic capacitor C3, reaches reference value Vpre1 (e.g., the voltage across electrolytic capacitor C3 reaches the predetermined value), comparator cmp2 may deactivate control signal Qpre1 to control switch S3 to be turned off, such that auxiliary circuit 52 may be turned off.

For example, while auxiliary circuit 52 charges electrolytic capacitor C3 by controlling transistor Q3 to be turned on, current control loop circuit 53 can control transistor Q2 to generate a current, in order to charge electrolytic capacitor C3. Thus, the pre-charge process of electrolytic capacitor C3 may be accelerated in certain embodiments, thereby further increasing the start-up speed of the dimmable LED driving circuit.

Current control loop 53 can include dimming circuit 531, error amplifier GM1, and a capacitor C4. Error amplifier GM1, capacitor C4, resistor R4 and transistor Q2 may form a controlled current source, which may be controlled by dimming signal Ldim2 to regulate the current on the closed loop where electrolytic capacitor C3 is located and/or the current on the loop where the LED load is located. Dimming circuit 531 can generate reference value Vref2 based on dimming signal Ldim2. Dimming circuit 531 may output reference value Vref2 according to a predetermined dimming curve after receiving dimming signal Ldim2. The dimming curve may include a logarithmic dimming curve and a linear dimming curve, which may be selected according to different application scenarios.

After the pre-charging phase of electrolytic capacitor C3 ends, current control loop circuit 53 can control the output current of the controlled current source (e.g., including error amplifier GM1, capacitor C4, resistor R4, and transistor Q2) according to dimming signal Ldim2, in order to continuously charge electrolytic capacitor C3, until the voltage across electrolytic capacitor C3 reaches the start-up voltage of the LED load, thereby activating the LED load. In particular embodiments, the pre-charging of the electrolytic capacitor and the closed-loop control of the dimmable LED driving circuit can be controlled by controlling different transistors, thereby further increasing the start-up speed of the dimmable LED driving circuit.

Figure 6:
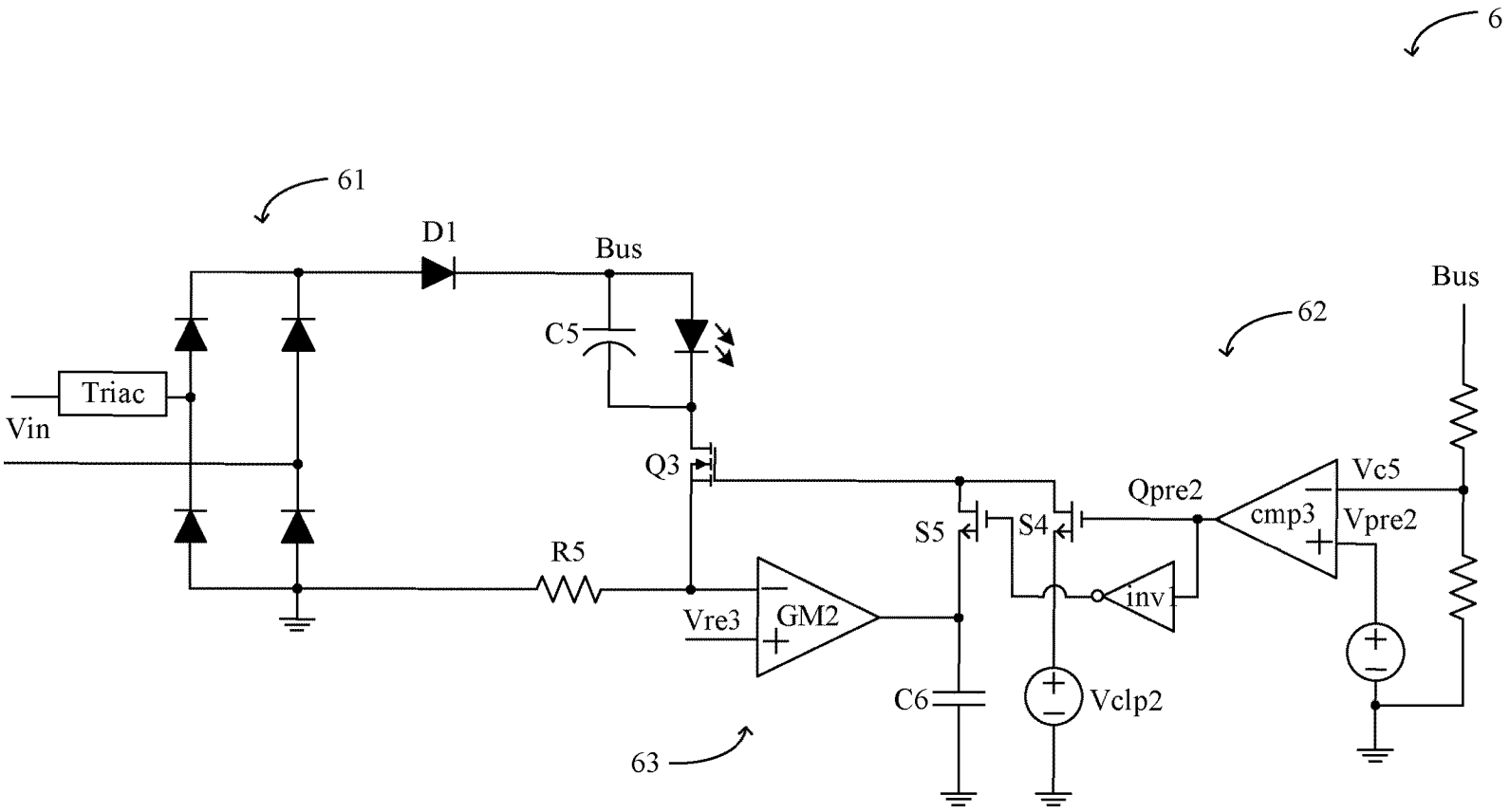
FIG. 6 is a schematic block diagram of a third example dimmable LED driving circuit, in accordance with embodiments of the present invention.

Referring now to FIG. 6, shown is a schematic block diagram of a third example dimmable LED driving circuit, in accordance with embodiments of the present invention. In this particular example, dimmable LED driving circuit 6 can include dimmer Triac, rectifier circuit 61, diode D1, electrolytic capacitor C5, transistor Q4, resistor R5, auxiliary circuit 62, and current control loop circuit 63. Dimmer Triac can connect between the alternating current input end and the input end of rectifier circuit 61, and may dim the LED load. For example, the dimmer may be a leading-edge phase-cut dimmer including a triac. Dimmer Triac has advantages of relatively small size, high withstand voltage, large capacity, strong function, fast response, high efficiency, and low cost. Dimming with a dimmer can make the dimmable LED driving circuit safer, more reliable, and more controllable. Diode D1 may prevent a reverse current. Rectifier circuit 61 can convert the alternating current input to a direct current output to direct current bus Bus. Electrolytic capacitor C5 can connect in parallel with the LED load between the output ends of dimmable LED driving circuit 6. Transistor Q3 can connect in series into a current loop of electrolytic capacitor C5.

Comparator cmp3 can control switches S4 and S5 to be turned on or turned off by comparing voltage sampling signal Vc5, which may represent the voltage across electrolytic capacitor C5, and reference value Vpre2, thereby controlling the pre-charging phase and the normal operation phase of the dimmable LED driving circuit. For example, voltage sampling signal Vc5 can be obtained by sampling the voltage at the output end of rectifier circuit 61, or by sampling the voltage at either end of electrolytic capacitor C5. Reference value Vpre2 may represent the predetermined value, which may be less than or equal to the start-up voltage of the LED load, and can be set according to the actual circuit structure and the parameters of each element and the sampling point of the voltage sampling signal.

When voltage sampling signal Vc5 is less than reference value Vpre2 (e.g., the voltage across electrolytic capacitor C5 is less than the predetermined value), switch S4 may be turned on, and switch S5 may be turned off. Auxiliary circuit 62 can charge electrolytic capacitor C5 with a predetermined pre-charge current. The predetermined pre-charge current may be set by setting the voltage of voltage source Vclp2. Further, the predetermined value may be less than or equal to the start-up voltage of the LED load. When voltage sampling signal Vc5 reaches reference value Vpre2 (e.g., the voltage across electrolytic capacitor C5 reaches the predetermined value), switch S4 may be turned off, and switch S5 may be turned on. Current control loop circuit 63 can perform closed-loop control according to reference value Vre3, such that the current flowing through the LED load may be a current corresponding to reference value Vre3.

In particular embodiments, the dimmable LED driving circuit can include the dimmer to dim the LED load. When the voltage across the electrolytic capacitor is less than the start-up voltage of the LED load, the electrolytic capacitor may be additionally charged by the auxiliary circuit to reduce the time required for the voltage across the electrolytic capacitor reaches the start-up voltage of the LED load, thereby increasing the start-up speed of the dimmable LED driving circuit. Also, the additional current generated by the auxiliary circuit can speed up the startup of the silicon-controlled dimmer, thereby improving the efficiency of the circuit.

In one embodiment, a method of controlling a dimmable LED driving circuit, can include: (i) detecting a voltage across an electrolytic capacitor in the LED driving circuit; (ii) determining whether the voltage across the electrolytic capacitor is less than a predetermined value; and (iii) charging the electrolytic capacitor by an auxiliary circuit when the voltage across the electrolytic capacitor is less than the predetermined value, in order to reduce time required for the voltage across the electrolytic capacitor to rise to a start-up voltage of an LED load.

Figure 7:
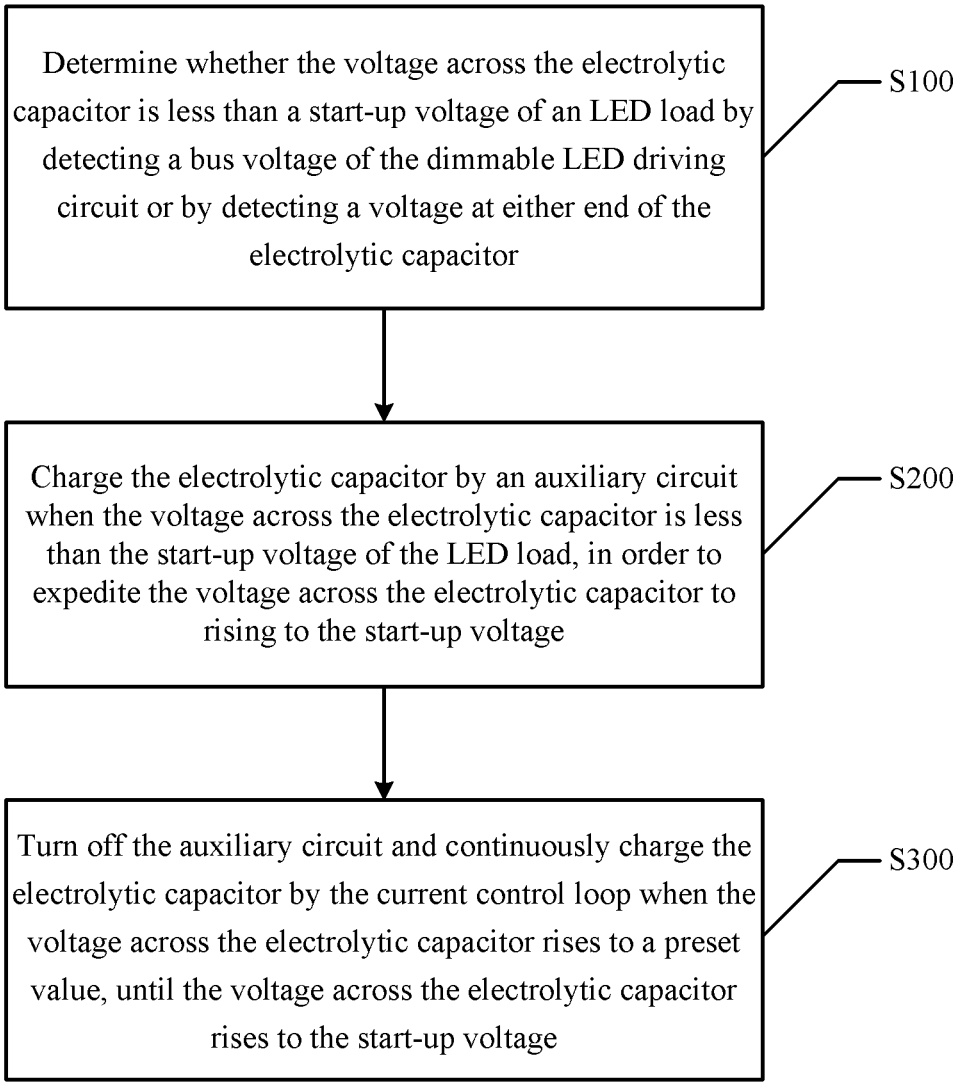
FIG. 7 is a flow diagram of an example dimmable LED driving method, in accordance with embodiments of the present invention.

Referring now to FIG. 7, shown is a flow diagram of an example dimmable LED driving method, in accordance with embodiments of the present invention. In this particular example, at S100, whether the voltage across the electrolytic capacitor is less than a predetermined value may be determined by detecting a bus voltage of the dimmable LED driving circuit, or by detecting a voltage at either end of the electrolytic capacitor. At S200, the electrolytic capacitor may be charged by an auxiliary circuit if the voltage across the electrolytic capacitor is less than the predetermined value, in order to reduce the time required for the voltage across the electrolytic capacitor rising to the start-up voltage. For example, the predetermined value may be less than or equal to a start-up voltage of an LED load.

At S300, if the voltage across the electrolytic capacitor rises to the predetermined value, the auxiliary circuit may be turned off. Further, the electrolytic capacitor may be continuously charged by a current control loop circuit when the voltage across the electrolytic capacitor rises to the predetermined value, and the current control loop circuit can regulate a current flowing through the LED load when the voltage across the electrolytic capacitor rises to the start-up voltage. Further, the electrolytic capacitor may be charged by the current control loop circuit when the voltage across the electrolytic capacitor is less than the start-up voltage, and the current control loop circuit can regulate the current flowing through the LED load when the voltage across the electrolytic capacitor rises to the start-up voltage.

In particular embodiments, when the voltage across the electrolytic capacitor is less than the start-up voltage of the LED load, the electrolytic capacitor may be additionally charged by the auxiliary circuit in order to reduce the time required for the voltage across the electrolytic capacitor rising to the start-up voltage of the LED load, thereby increasing the start-up speed of the dimmable LED driving circuit.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A method of controlling a dimmable light-emitting diode (LED) driving circuit, the method comprising:

a) detecting a voltage across an electrolytic capacitor in the LED driving circuit;

b) determining whether the voltage across the electrolytic capacitor is less than a predetermined value; and c) charging the electrolytic capacitor by an auxiliary circuit when the voltage across the electrolytic capacitor is less than the predetermined value, in order to reduce time required for the voltage across the electrolytic capacitor to rise to a start-up voltage of an LED load, wherein the electrolytic capacitor is directly coupled in parallel to the LED load in order to supply a voltage to dive the LED load.

2. The method of claim 1, further comprising turning off the auxiliary circuit when the voltage across the electrolytic capacitor rises to the predetermined value, wherein the predetermined value is less than or equal to the start-up voltage.

3. The method of claim 1, wherein the determining whether the voltage across the electrolytic capacitor is less than the predetermined value comprises detecting at least one of: a bus voltage of the dimmable LED driving circuit, and a voltage at either end of the electrolytic capacitor.

4. The method of claim 2, further comprising:

a) continuously charging the electrolytic capacitor by a current control loop circuit when the voltage across the electrolytic capacitor rises to the predetermined value; and b) regulating a current flowing through the LED load by the current control loop circuit when the voltage across the electrolytic capacitor rises to the start-up voltage.

5. The method of claim 2, further comprising:

a) charging the electrolytic capacitor by a current control loop circuit when the voltage across the electrolytic capacitor is less than the start-up voltage; and b) regulating a current flowing through the LED load by the current control loop circuit when the voltage across the electrolytic capacitor rises to the start-up voltage.

6. A dimmable light-emitting diode (LED) driving circuit, the driving circuit comprising:

a) an electrolytic capacitor directly coupled in parallel to an LED load such that the electrolytic capacitor is configured to supply a voltage to drive the LED load; and b) an auxiliary circuit configured to, when determining that a voltage across the electrolytic capacitor is less than a predetermined value, charge the electrolytic capacitor to reduce time required for the voltage across the electrolytic capacitor to rise to a start-up voltage of an LED load.

7. The driving circuit of claim 6, wherein:

a) the auxiliary circuit is further configured to be turned off when the voltage across the electrolytic capacitor rises to the predetermined value, and b) the predetermined value is less than or equal to the start-up voltage.

8. The driving circuit of claim 6, wherein the auxiliary circuit is configured to determine whether the voltage across the electrolytic capacitor is less than the predetermined value by detecting a voltage at either end of the electrolytic capacitor.

9. The driving circuit of claim 6, further comprising a rectifier circuit, wherein the auxiliary circuit is configured to determine whether the voltage across the electrolytic capacitor is less than the predetermined value by detecting a voltage at an output end of the rectifier circuit.

10. The driving circuit of claim 6, further comprising a current control loop circuit configured to, when the voltage across the electrolytic capacitor rises to the start-up voltage, adjust a current flowing through the LED load according to a first reference value.

11. The driving circuit of claim 10, wherein when the voltage across the electrolytic capacitor rises to the predetermined value, the current control loop circuit is configured to continuously charge the electrolytic capacitor until the voltage across the electrolytic capacitor rises to the start-up voltage.

12. The driving circuit of claim 10, wherein the current control loop circuit is configured to charge the electrolytic capacitor when the voltage across the electrolytic capacitor is less than the start-up voltage.

13. The driving circuit of claim 10, wherein the auxiliary circuit is configured to detect the voltage across the electrolytic capacitor to generate a voltage sampling signal, and to generate a control signal by comparing the voltage sampling signal against a second reference value, wherein the second reference value corresponds to the predetermined value.

14. The driving circuit of claim 13, further comprising a first transistor coupled in series into a current loop of the electrolytic capacitor, wherein the first transistor is controlled by the control signal to generate a pre-charge current for charging the electrolytic capacitor.

15. The driving circuit of claim 14, wherein the current control loop circuit is configured to control the first transistor to generate a current for continuously charging the electrolytic capacitor according to the first reference value when the voltage across the electrolytic capacitor rises to the predetermined value.

16. The driving circuit of claim 13, further comprising:

a) a first transistor coupled in series into a current loop of the electrolytic capacitor; and b) a second transistor coupled in parallel with the first transistor, wherein the second transistor is controlled by the control signal to generate a pre-charge current for charging the electrolytic capacitor.

17. The driving circuit of claim 16, wherein the first transistor is controlled by the current control loop circuit to generate a current for charging the electrolytic capacitor according to the first reference value when the voltage across the electrolytic capacitor is less than the start-up voltage.

18. The driving circuit of claim 10, wherein the first reference value varies with a dimming signal.

19. The driving circuit of claim 10, further comprising a dimmer configured to receive an alternating current input, and to generate an adjustable signal in order to dim the LED load.

20. An integrated circuit comprising the driving circuit of claim 6, and further comprising a controlled current source, wherein the auxiliary circuit is configured to regulate a current supplied by the controlled current source in order to charge the electrolytic capacitor.

* * * * *